United States Patent [19]

Mosier

[11] Patent Number: 4,649,688

[45] Date of Patent: Mar. 17, 1987

[54] FLOOR LOADED PLATFORM TRUSS

[76] Inventor: Leo D. Mosier, 322 Euclid Ave., Sheboygan, Wis. 53081

[21] Appl. No.: 715,891

[22] Filed: Mar. 25, 1985

[51] Int. Cl.[4] ..... E04B 1/32; E04B 7/08; E04C 3/38

[52] U.S. Cl. ..... 52/644; 52/693; 14/9; 403/231

[58] Field of Search ..... 52/639–644, 52/690–693, 637, 638, 86; 14/3, 9; 403/231, 233, 232

[56] References Cited

U.S. PATENT DOCUMENTS

| | | | |
|---|---|---|---|
| 212,941 | 10/1878 | Jarvis | 14/9 |
| 315,259 | 4/1885 | Douglas | 14/12 |
| 1,961,967 | 6/1934 | Goranson | 52/637 |
| 2,148,110 | 2/1939 | Davis | 52/642 |
| 2,153,884 | 4/1939 | Goins | 52/637 |
| 2,770,846 | 11/1956 | Findleton | 52/642 |
| 4,393,637 | 7/1983 | Mosier | 52/642 |

FOREIGN PATENT DOCUMENTS

| | | | |
|---|---|---|---|
| 179072 | 10/1952 | Austria | 52/87 |
| 402571 | 3/1943 | Italy | 52/639 |
| 641984 | 8/1950 | United Kingdom | 52/638 |

*Primary Examiner*—James L. Ridgill, Jr.

*Attorney, Agent, or Firm*—Silverman, Cass, Singer & Winburn, Ltd.

[57] ABSTRACT

An improvement in the art of bowstring roof truss construction comprising an altered web pattern in which the diagonal and vertical webs, normally converging at points alternately within the geometric confines of the top chord and the bottom chord, intersect or converge rather at points intermediate between top and bottom chord on massive vertical webs. This system facilitates more head room and walk-through space where a floor is framed into the bottom chord of the truss. This system comprises (1) an arched top chord with intersecting vertical and diagonal webs, (2) displaced intersection points of the diagonal webs onto the massive vertical webs, (3) a suspension assembly to hang the bottom chord using direct bearing and (4) a separate assembly to transmit the longitudinal truss-action forces from the vertical webs to the bottom chord.

11 Claims, 9 Drawing Figures

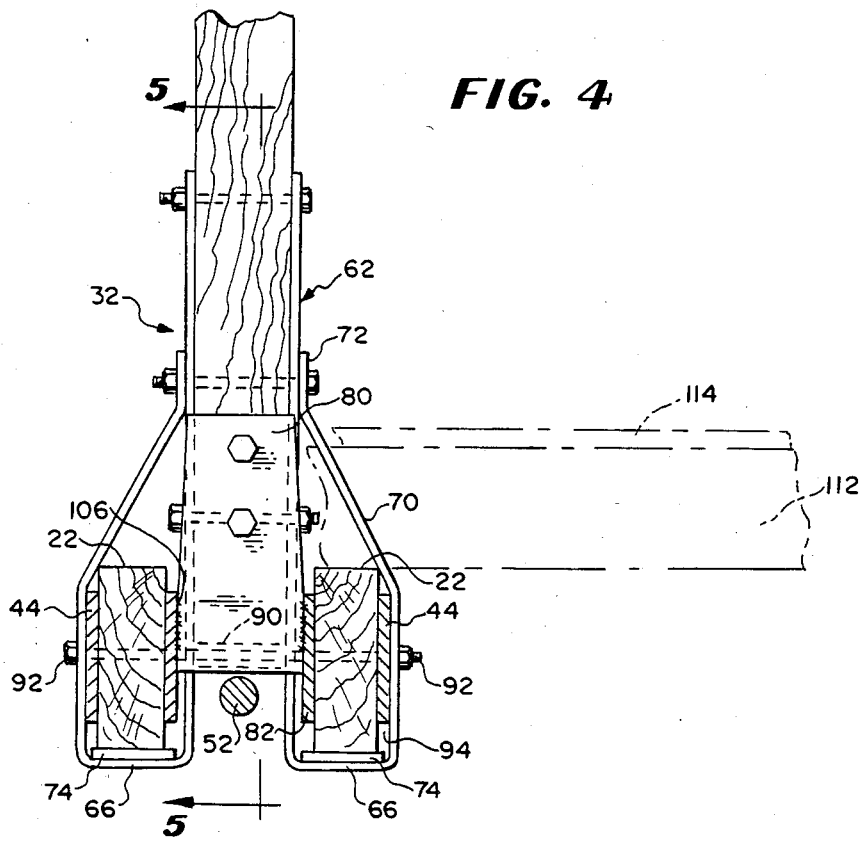
FIG. 4
FIG. 5
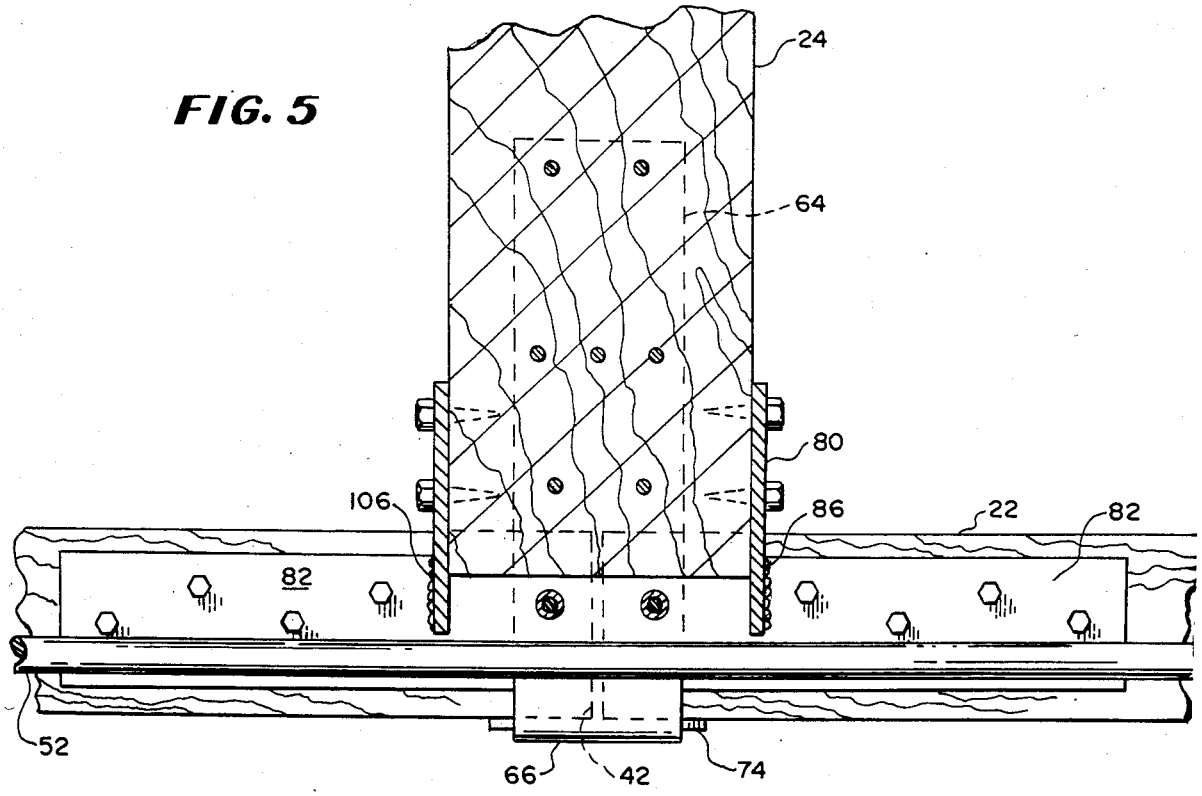

FLOOR LOADED PLATFORM TRUSS

CROSS-REFERENCE TO RELATED PATENTS

Reference is made to U.S. Pat. Nos. 2,770,846 to R. J. Findleton granted Nov. 20, 1956, 4,393,637 to Leo D. Mosier granted July 19, 1983 and 212,941 to Jarvis granted Oct. 29, 1878.

BACKGROUND OF THE INVENTION

This invention relates generally to roof truss construction and more particularly provides a displaced diagonal web system for a bowstring type roof truss which facilitates the inclusion of an unobstructed floor system at the bottom chord.

The considerable space defined between the top and bottom chords of a long span roof truss system is generally wasted due to interference with passage occasioned by the diagonal webs. It may be highly desirable to convert such wasted space to usable space by framing a floor system directly into the bottom chord. However, to provide unrestricted walk-through access between bays, the bottom intersection point of the diagonal web members must be raised to a location displaced substantially upward from the bottom chord and approaching a position midway between the top and bottom chords which is at shoulder height or thereabout.

In considering steel truss systems, one may totally eliminate the diagonals, replacing their function with welded continuity of massive vertical elements. This type of truss is generally termed a "Vierendeel" truss system. The problem of vertical plane bending in both the webs and the chords is experienced. The "Vierendeel" type truss system can be defined as an untriangulated perpendicular lacing between compression and tension chords in a structural system for resisting load components perpendicular to the longitudinal axis in which composite rigidity is accomplished by bending strength continuity between the chords and the connecting webs rather than additional diagonal members to the joints.

On a practical basis, in using wood one cannot achieve joint continuity sufficient to create a reliable Vierendeel bending continuity between the top and bottom chords. Even in steel framing the Vierendeel truss has limited practical use because of high cost. Elimination of diagonals necessitates supplanting normal truss action with more costly bending in either or both top and bottom chords.

SUMMARY OF INVENTION

In view of the expense involved in the typical Vierendeel type truss system and the near impossibility of employing such type system in wood framing, there is a need for an alternative construction for providing a walk-through web pattern in a roof truss system, and particularly a system adaptable toward employing wood as a construction material. The inventive innovation of the system described herein is limited to the raised diagonal web intersection normally otherwise to be located at the bottom chord and to the bottom chord suspension system. The actual diagonal web connections to top chord and vertical web can be worked out according to any applicable standard procedure. Likewise the entire construction top to bottom from the bearing end of the truss to the first massive vertical web can be worked out in acceptable established procedures. The unique truss configuration herein described, rather than eliminating the diagonal webs as occurs in the Vierendeel, displaces them upwardly, and the resulting truss-action bending is confined to the massive vertical webs. Also, contrary to the Vierendeel concept, the vertical webs do not require a bending continuity with the chords and, as actually defined herein, approach what is termed as a "hinge connection" for analysis purposes.

The connection means herein provided at the bottom chord has the capability of hanging a heavily loaded bottom chord from the vertical webs so as to avoid possible and undesirable outward lateral twisting at the respective points of connection to the vertical webs. The hanging stirrups used here have the advantage of reducing the risk involved in the possibility of the supported weight overloading the bolted connections to the vertical webs, or in other words the advantage of reducing the criticality of vertical load transfer from the bottom chord to the top chord. The hanger may be either the closed loop stirrup type of suspension or a flat bearing plate welded to and symmetrically oriented to a centered stem. This second system, although deemed not quite as foolproof and indestructible as the closed loop, has an advantage of open accessibility for mounting the bottom chord beam sections.

Of further note, the bottom chord web connection systems provided by the invention serve to separate the connection's two functions: (1) vertical load suspension and (2) the mechanism for longitudinal truss action forces between the web and the bottom chord. The method by which this is herein accomplished eliminates all prying action on the connection bolts, prying action being an undesirable and often unpredicted action in both steel and timber framing. An oversized conventional gusset-plate type of connection at the bottom chord is a less-than-optimum alternative, and ruled out of this discussion because it would protrude above the floor.

The truss web pattern system provided herein is particularly adaptable to a bowstring truss having a rod-reinforced bottom chord such as the type described in U.S. Pat. No. 4,393,037. In such construction, the centered rod takes the bulk of the bottom chord tension while the bottom bichord is used to absorb and resolve to the bearing ends of the truss the web forces caused by loading irregularities on the top chord arch.

It should be noted that the capabilities and advantages of the structure presented herein are not limited to a timber bottom chord such as constitutes the truss of the referenced U.S. Pat. No. 4,393,637. The bottom chord beam members spanning between panel support points could be formed of precast concrete or even of steel beams.

The centered horizontal tension member can be designed to take all or a portion of the overall tension tie force. As illustrated, the splice plates at the joints between bottom chord members are of substantial size and length being able to resist a considerable portion of the shared tension load. The centered rod may, however, be designed to take all the tension with the bottom bichord serving as a compression strut absorbing the longitudinal thrust of the massive vertical webs and transmitting this force across the butt joints in compression to one or the other end. Under such conditions, the counterpart of the splice plate can be rather short and its connection to the vertical web manifestly incapable of safely supporting the vertical load component, which may be as much as 50,000 lbs. in a 150 foot span. Under these conditions a second device to support the vertical load becomes mandatory.

Accordingly, the hanger construction provided by the invention incorporates an additional separated device to support the heavy vertical load component, thereby eliminating the prying and twisting forces that would otherwise occur in the bolted connection.

BRIEF DESCRIPTION OF THE DRAWINGS

FIG. 4 is an enlarged cross-sectional view taken along line 4—4 of FIG. 3 viewed looking toward the right;

FIG. 5 is an enlarged sectional view taken through the vertical strut on line 5—5 of FIG. 4 viewed in direction indicated;

DESCRIPTION OF PREFERRED EMBODIMENTS

As will be understood from the hereinafter description to follow, the invention is directed to a platform bow roof truss which includes top and bottom chords secured at their ends along with massive vertical struts spaced at intervals along the span of the truss and connected to the top and bottom chords. Depending converging diagonal struts are provided secured to the top chord and arranged to intersect the massive vertical struts at points of connection located between the top and bottom chords. A tributory floor supported by the bottom chord is implied in this arrangement, whereby the walk-through interference of the diagonal webs is minimized by the raising of the diagonal web connection normally at the bottom chord to approximately shoulder height on the vertical web. Suspension assemblies are provided to couple the bottom chord to the vertical struts and support said chord.

Figure 1:
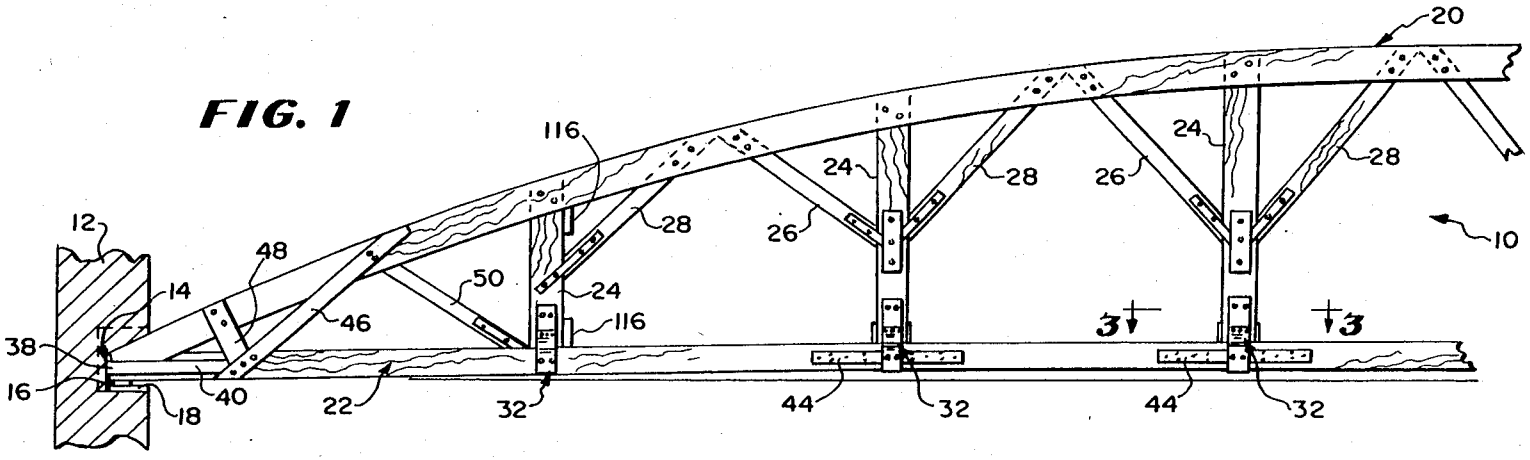
FIG. 1 is a side elevation view of the left half of a platform bow roof truss constructed in accordance with the invention.
Figure 2:
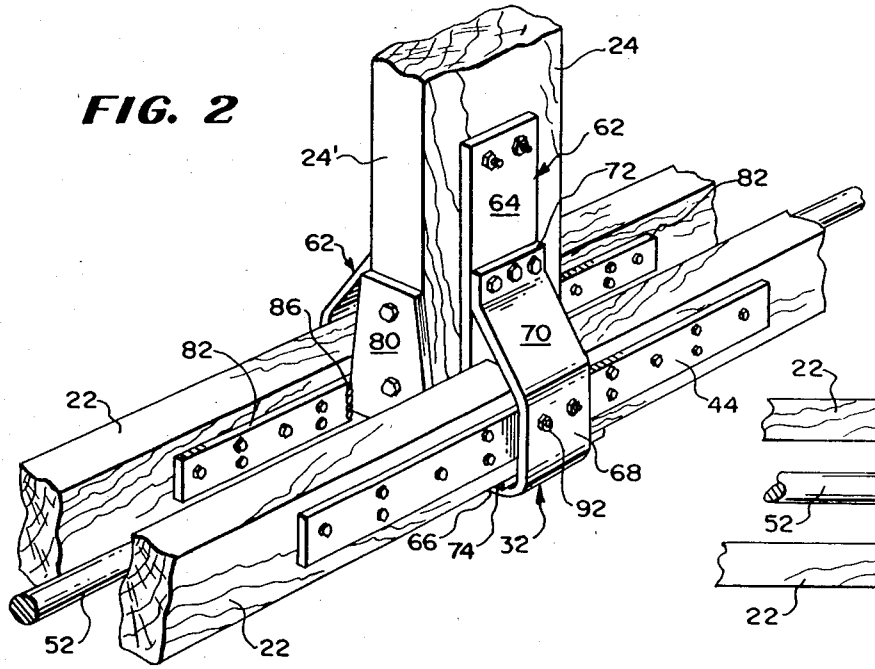
FIG. 2 is an enlarged fragmentary perspective view of a vertical suspension system for coupling the vertical strut to the bottom chord of the roof truss illustrated in FIG. 1.
Figure 3:
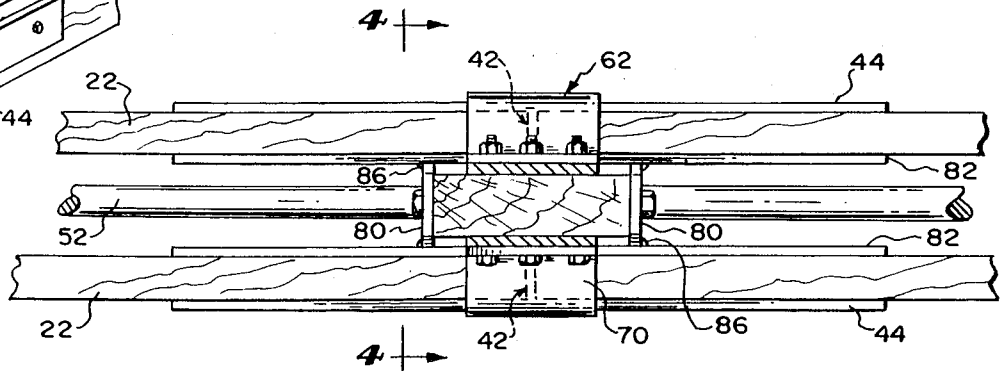
FIG. 3 is an enlarged fragmentary horizontal sectional view taken through the bottom chord along lines 3—3 of FIG. 1 viewed looking downward.
Figure 6:
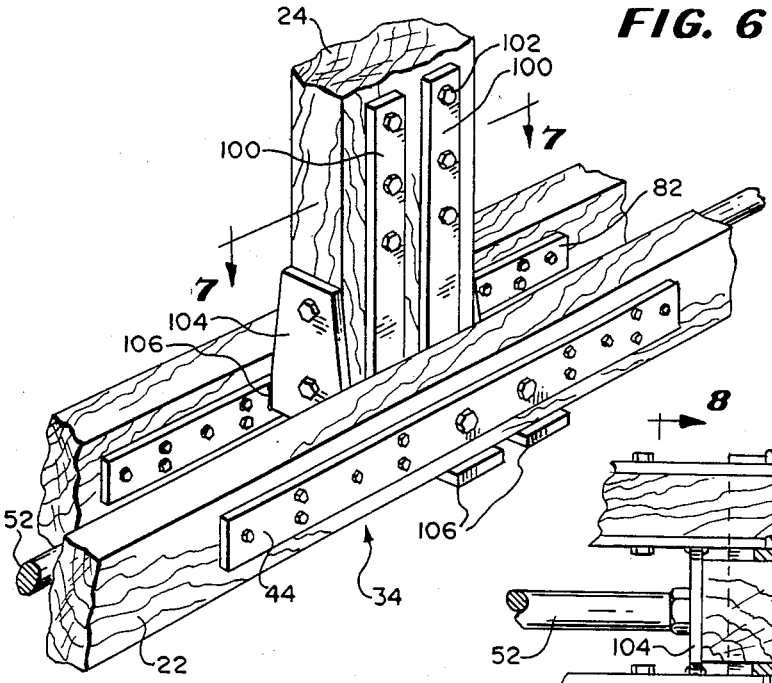
FIG. 6 is an enlarged fragmentary perspective view of an alternate type vertical suspension system for coupling the vertical strut to the bottom chord.
Figure 7:
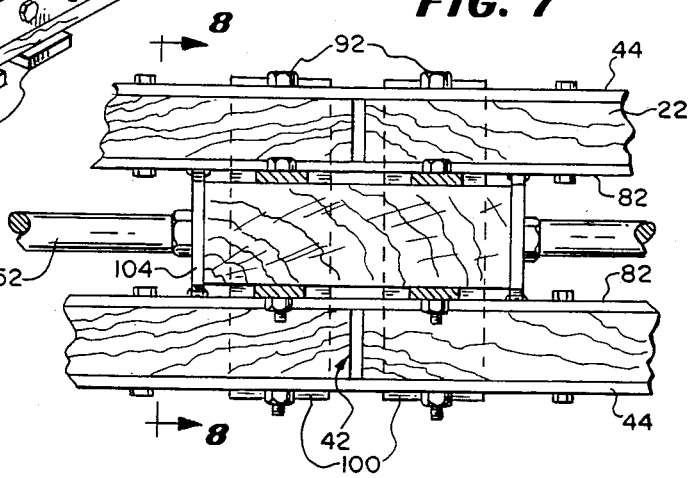
FIG. 7 is a fragmentary horizontal sectional view taken through the bottom chord along the line 7—7 of FIG. 6 viewed looking downward.
Figure 8:
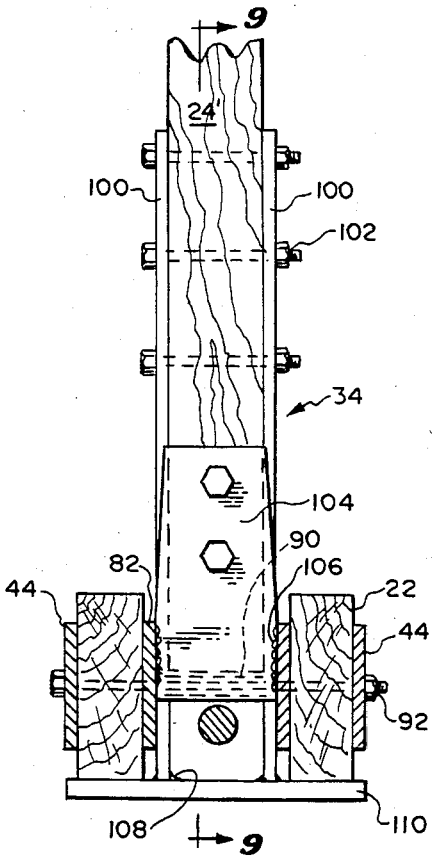
FIG. 8 is a cross-sectional view taken along lines 8—8 of FIG. 7 viewed looking to the right.
Figure 9:
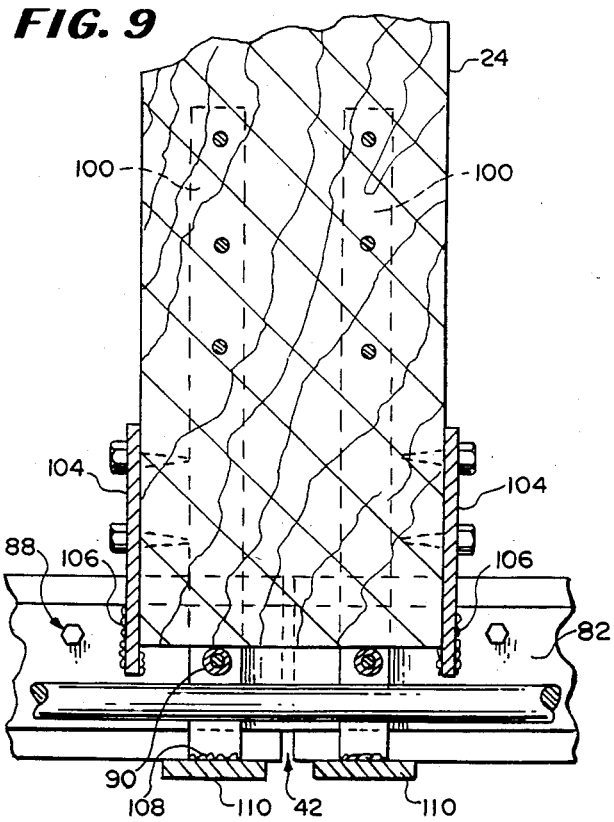
FIG. 9 is a sectional view taken through the vertical strut along lines 9—9 of FIG. 8 and viewed in the direction indicated.

Referring to the drawings, there is illustrated a roof truss construction embodying the invention and designated by reference character 10 in FIG. 1. The roof truss construction 10 is shown installed on a building wall 12. Only the lefthand portion of the span is illustrated, as the remaining portion of the span is constructed in substantially identical configuration. The left hand end 14 of the roof truss construction 10 is seated in pocket 16 fastened to bearing plate 18 secured within said pocket.

The roof truss construction 10 comprises a top chord 20, a bottom chord 22 and a plurality of massive vertical strut members 24 arranged spaced apart along the longitudinal axis of the truss and connecting the top and bottom chords 20 and 22. Pairs of diagonal struts 26 and 28 are arranged depending from the top chord converging to a location 30 for securement to the massive vertical struts respectively to define with the vertical strut 24 a plurality of web formations. The locations 30 where the diagonal struts 26 and 28 intersect and are joined to massive vertical strut 24 for each web formation are at an elevation intermediate between the top and bottom chords.

Preferably, in accord with the invention, the point of intersections are spaced sufficiently from the bottom chord 22 to define space to accommodate an uninterrupted walkway or storage space. Each of the massive vertical struts is secured coupled to the bottom chord 22 through vertical suspensions 32 and/or 34 to be described.

The bearing ends 36 of the top chord 20 are secured to the ends 38 of the bottom chord 22. The bottom chord 22 is formed of plural lengths assembled in butt joints 42 respectively employing lap splice plates 44 bridging said joints 42.

Lacing planks 46, 48 and 50 represent an ordinary truss web construction between the bearing ends of the roof truss 10 and the connection assembly 51 which is attached to the vertical strut 24 nearest the bearing ends of the truss construction 10.

Preferably, the bottom chord 22 is constructed in the form of a bichord consisting of a pair of side by side laterally separated timbers or beams similar in size and appearance but spaced to permit a tension member 52 which is presumably steel, to be accommodated therebetween. The diagonal strut 50 is secured at its upper end to the top chord 20 while being secured at the bottom end to either the bottom chord 22 or the leftmost vertical strut 24.

A tension member 52 is located horizontally oriented between the pair of adjoined members of the bichord and parallel thereto.

The massive vertical struts 24 can be connected to the bottom bichord 22 by either the suspension system 32 or the suspension system 34 illustrated in FIGS. 2–5 and 6–9 respectively.

The suspension system 32 comprises a pair of stirrup-type strap members 62, each formed of a flat bar extending upward along the longitudinal vertical plane formed by the wide sides of strut 24 to a point of securement, a flat horizontal plane base 66, and a return bend forming the arm 68 including a vertically sloping diagonal section 70 terminating in flange 72. A bearing plate 74 is secured between the base 66 and the bottom surface of each bichord bichord member 22.

The portion of the bichord 22 at which the bottom of the plate 74 is located preferably laps the butt joint 42. The separate assembly which functions to transmit the longitudinal truss action force from the vertical web to the bottom chord is illustrated by plates 80 secured to the opposed narrow sides 24' of strut 24. Outer splice plates 44 and inner splice plates 82 are secured to the respective bichord members longitudinally on opposite sides thereof to bridge the butt joints 42. The vertical bearing plates 80 are weldably secured at 86 to the adjacent splice plates 82 which are located on the inner facing sides of each bichord with the bichord members and splice plates secured via transverse bolts 88. Pipe sleeve spacer 90 on through bolt 92 is positioned in the gap formed at the lower end of the vertical strut 24. The arms 64 and 70 along with bends 66 and 68 define loops 94 through which the bichord members are received.

The suspension system 34 employs two pair of hanger plates 100, each pair being bolted to the vertical strut on opposite sides thereof using through bolts 102 which pass through said vertical strut and hanger plates on opposite sides of said strut 24. The hanger plates 100 extend below the vertical strut and are weldably secured at 108 to the top surface of base plate 110 with the latter extending transverse to the bottom bichord to support the bichord members 24. The said separate assembly includes side bearing plates 104 weldably secured at 106 to the splice plates 82 and secured to the opposite short sides 24' of the strut 24. The system 34 has the advantage of not requiring the threading of the bichord members through loops and hence is easier to assemble and install than the stirrup type system 32.

The roof truss sections 10 are arranged at a uniform spacing spanning between bearing walls 12. Floor joists 112 span transversely between the chords 22 (as represented in FIG. 4). The roof structure supported on the top chord 20 of truss 10 has not been shown. A tributory floor 114 is supported on the joists 112. Erection bracing 116 may be attached to verticals 24 of truss 10.

It should be understood that while the specific embodiment of the herein invention is described as formed of wood, the chords, particularly the bottom chord, may be advantageously formed of other materials, such as steel, concrete, etc. The principles of the invention are not to be limited to wood but interpreted as to scope to the claims appended hereto.

I claim:

1. In a load-resisting roof truss, an arched top chord spanning between end reaction points, a continuous horizontal bottom chord terminating at points of securement to said top chord at said end reaction points, a multiple web system between said top and bottom chords comprising plural spaced massive vertical webs extending between upper and lower ends fixedly secured respectively to said top chord and bottom chord, suspension means for supporting said bottom chord from the lower ends of said massive vertical webs, and diagonal webs each fixedly secured to said top chord and converging respectively toward and terminating at the nearest massive vertical web at a location along the web between the top and bottom chords, said location being displaced substantially upward from the bottom chord and approaching a position midway between said top and bottom chords and defining walk-through clearance within said web system.

2. The roof truss as claimed in claim 1 wherein said diagonal webs are arranged in converging pairs.

3. The roof truss as claimed in claim 1 wherein said suspension means comprises a suspension assembly including strap means looped around the bottom chord and secured to the massive vertical webs.

4. The roof truss as claimed in claim 3 and including a second assembly fixedly securing the massive vertical webs longitudinally and comprising vertical bearing means secured to the lower portion of said massive vertical webs and said bearing means comprising vertical bearing plate means bearing against said massive vertical webs and independent of said suspension assembly and horizontal plate means rigid with said vertical plate means, said horizontal plate means extending along and engaged with said bottom chord.

5. The roof truss as claimed in claim 1 wherein said suspension means comprise a suspension assembly including plate means fastened to each vertical web and depending therebelow, and transverse means fixedly secured to said plate means and disposed in underlying supporting relation to said bottom chord.

6. The roof truss as claimed in claim 5 and including a second assembly fixedly securing the massive vertical webs longitudinally and comprising vertical bearing means secured to the lower portion of said massive vertical webs and said bearing means comprising vertical bearing plate means bearing against said massive vertical webs and independent of said suspension assembly and horizontal plate means rigid with said vertical plate means, said horizontal plate means extending along and engaged with said bottom chord.

7. In a gravity loaded bowstring type truss including an arched top chord and a bottom chord, the combination of massive vertical webs extending between and fixedly connecting the top and the bottom chords, plural diagonal webs fixed to and extending from the top chord and terminating at the massive webs at points displaced from the bottom chord substantially upward along the massive vertical webs to intermediate locations approaching midway between the top and bottom chords and means fixedly connecting each of the massive vertical webs to the bottom chord, said means comprising a vertical load suspension assembly and a completely separated functionally independent longitudinal force transfer assembly secured to the bottom chord and bearing longitudinally against the lower portion of the massive vertical web to transmit the longitudinal truss-action force from said massive vertical webs to the bottom chord.

8. The truss as claimed in claim 7 wherein said longitudinal force transfer assembly comprises vertical bearing plate means secured to the lower portion of said massive vertical web and horizontal plate means rigid with said vertical bearing plate means, said horizontal plate means extending longitudinally along and engaged with said bottom chord.

9. The truss as claimed in claim 7 wherein said vertical load suspension assembly comprises hanger means secured to the massive vertical web and depending therefrom, said hanger means including a horizontal portion underlying and supporting said bottom chord.

10. The truss as claimed in claim 9 wherein said hanger means define closed loops encircling said bottom chord.

11. The truss as claimed in claim 9 wherein said longitudinal force transfer assembly comprises vertical bearing plate means secured to the lower portion of said massive vertical web and horizontal plate means rigid with said vertical bearing plate means, said horizontal plate means extending longitudinally along and engaged with the bottom chord.

* * * * *